United States Patent [19]

Winter

[11] Patent Number: 4,995,175

[45] Date of Patent: Feb. 26, 1991

[54] PNEUMATIC EXTRACTION HEAD

[76] Inventor: Johann Winter, Welkfeldstr. 9, 7085, Bopfingen-Aufhausen, Fed. Rep. of Germany

[21] Appl. No.: 424,263

[22] PCT Filed: Apr. 27, 1988

[86] PCT No.: PCT/EP88/00355

§ 371 Date: Oct. 20, 1989

§ 102(e) Date: Oct. 20, 1989

[87] PCT Pub. No.: WO88/08470

PCT Pub. Date: Nov. 3, 1988

[30] Foreign Application Priority Data

Apr. 28, 1987 [DE] Fed. Rep. of Germany ..... 3714073

[51] Int. Cl.[5] ..... E02F 3/88

[52] U.S. Cl. ..... 37/63; 37/58

[58] Field of Search ..... 37/54, 58, 59, 60, 61, 37/62, 63, 72

[56] References Cited

U.S. PATENT DOCUMENTS

| | | | |
|---|---|---|---|
| 3,301,606 | 1/1967 | Bruno . | |
| 3,585,739 | 6/1971 | DeKoning | 37/58 |
| 3,585,740 | 6/1971 | DeKoning | 37/63 |
| 3,756,659 | 9/1973 | DeKoning | 37/58 |
| 3,791,763 | 2/1974 | Faldi | 37/58 X |
| 4,253,255 | 3/1981 | Durell | 37/59 X |
| 4,353,174 | 10/1982 | Maloblocki | 37/58 |
| 4,386,473 | 6/1983 | Amann et al. | 37/58 X |

FOREIGN PATENT DOCUMENTS

| | | |
|---|---|---|
| 858974 | 12/1952 | Fed. Rep. of Germany . |
| 1802158 | 6/1969 | Fed. Rep. of Germany . |
| 2241526 | 3/1974 | Fed. Rep. of Germany . |
| 1243065 | 8/1971 | United Kingdom . |

*Primary Examiner*—Dennis L. Taylor
*Assistant Examiner*—J. Russell McBee
*Attorney, Agent, or Firm*—Spencer & Frank

[57] ABSTRACT

A pneumatic extraction head for underwater debris, in particular sand and gravel, has a joint or connecting pipe extending inside the housing between the base plate and the flange plate and surrounding the debris inlet opening, this connecting pipe forming an annular compressed air space between the inner wall of the housing and the outer wall of the connecting pipe; several mutually-spaced compressed air outlet openings provided in the base plate in the compressed air space around the debris inlet opening; and nonreturn valves for controlling the exit of compressed air out of the compressed air outlet openings.

11 Claims, 5 Drawing Sheets

PNEUMATIC EXTRACTION HEAD

CROSS REFERENCE TO RELATED APPLICATION

This application claims the priority of Federal Republic of Germany Application No. P 37 14 073.6, filed Apr. 28th, 1987, which is incorporated herein by reference.

BACKGROUND OF THE INVENTION

The invention relates to a pneumatic extraction head for underwater debris, in particular sand and gravel, comprising a housing, a base plate located at the bottom of the housing and forming an inlet opening for the debris and a flange plate located at the top of the housing for connection with an extraction pipe and a compressed air duct.

An extraction head of this type is known from DE-OS 22 41 526. With this extraction head, the extraction capacity is often not at an optimum due to the fact that compressed air is supplied only from the side and the debris inlet opening also extends laterally. In addition, this extraction head is subject to considerable, unsymmetric wear and tear which necessitates frequent servicing and repair.

OBJECTS AND SUMMARY OF THE INVENTION

The object of the invention is to remedy these deficiencies and to improve the supply of compressed air in a generic pneumatic extraction head such that a large, constant extraction capacity can be attained with a minimum of wear and tear.

The object is accomplished in accordance with the invention by the following features:

a. a joint or connecting pipe extending inside the housing between the base plate and the flange plate and surrounding the debris inlet opening, this connecting pipe forming an annular compressed air space between the inner wall of the housing and the outer wall of the connecting pipe, b. several mutually-spaced compressed air outlet openings provided in the base plate in the compressed air space around the debris inlet opening and c. nonreturn valves for controlling the exit of compressed air out of the compressed air outlet openings.

BRIEF DESCRIPTION OF THE DRAWINGS

The following description of the preferred embodiment of the invention serves to explain the invention in greater detail in conjunction with the attached drawings, in which.

DETAILED DESCRIPTION OF THE PREFERRED EMBODIMENT

Figure 1:
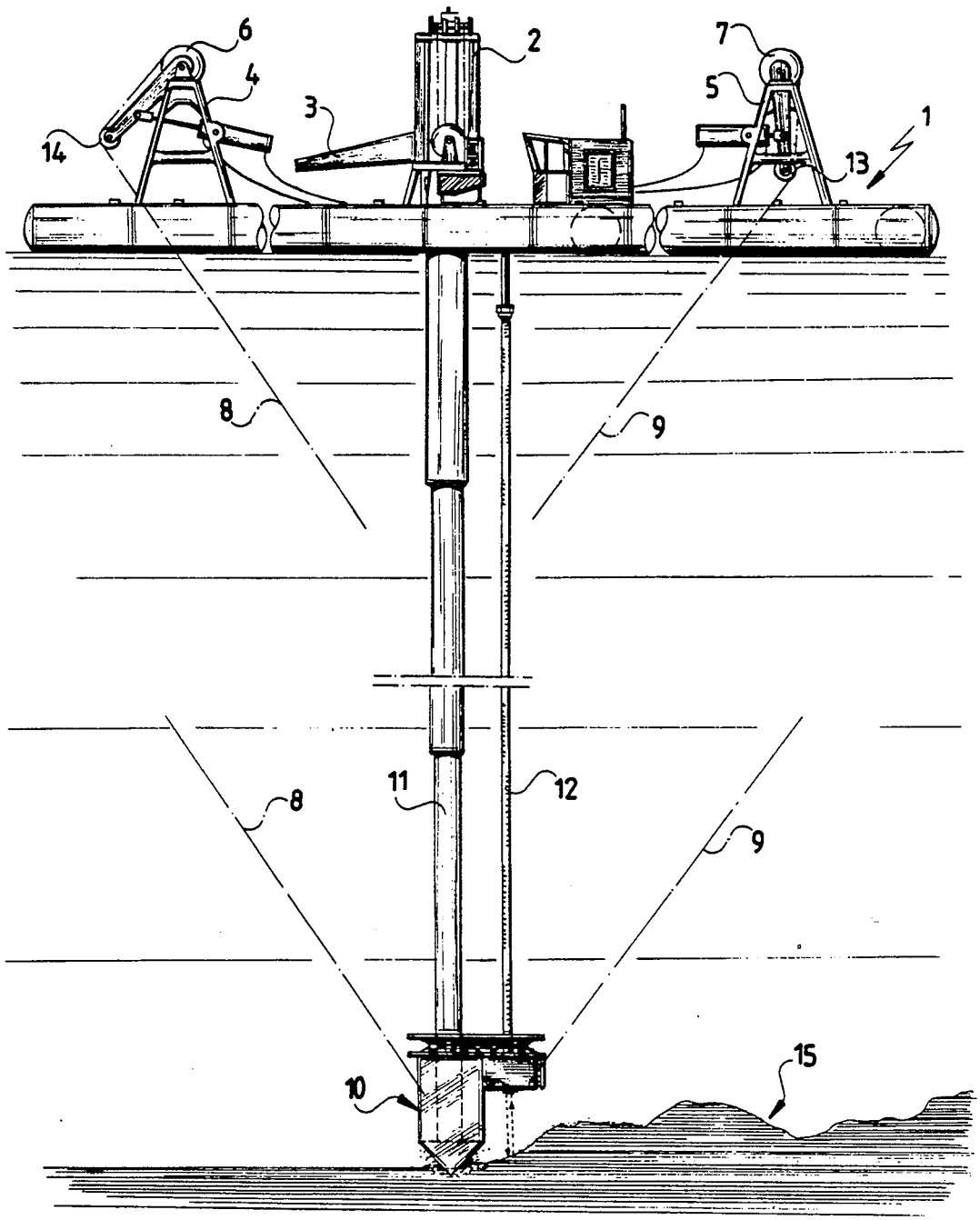
FIG. 1 is a schematic view of a pneumatic extraction head during removal of underwater debris.

The apparatus illustrated in FIG. 1 comprises a float 1, on which a rebound tank 2 with a drainage channel 3 is arranged. Lifting jacks 4, 5 are arranged on the float 1 approximately at the same distance to the left and right of the rebound tank 2. These jacks each bear a motor-driven hoist 6 and 7, respectively. Cables 8, 9 which are indicated in FIG. 1 by dash-dot lines lead from these hoists to an extraction head 10 which is connected with the rebound tank 2 via a telescopic extraction pipe 11 which is variable in length. A compressed air duct 12 extends parallel to the extraction pipe 11. This compressed air duct opens at one end in the extraction head 10 and is connected at the other end with a pneumatic pump which is located on the float 1 but not illustrated. Apart from compressed air, pressurized water can be used as pressure medium. By activating the hoist 4, 5 the extraction head 10 can be lowered and lifted and thereby held in its operative position on the underwater debris 15. The duct 12 is a windable tube.

Figure 2:
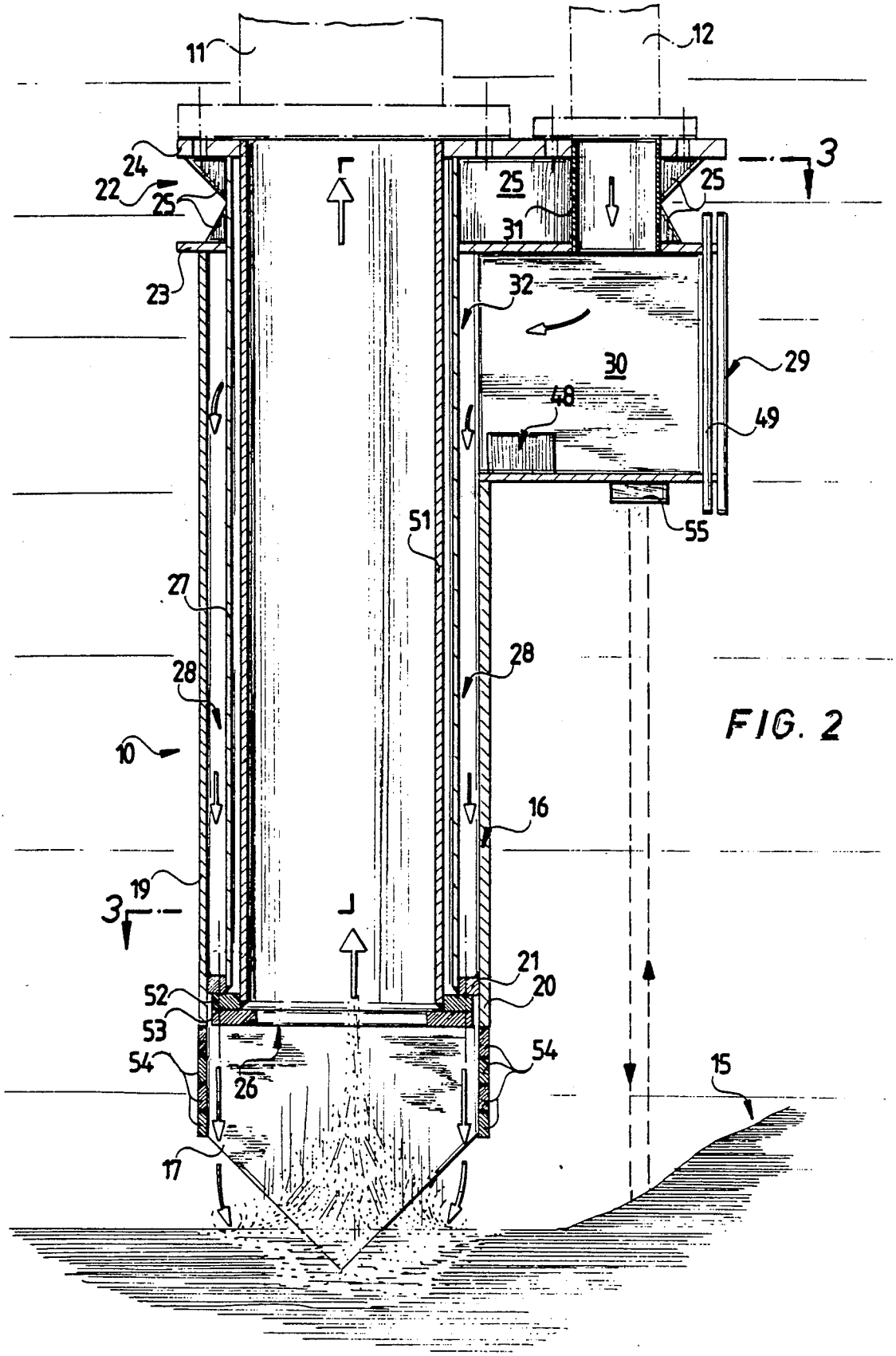
FIG. 2 shows a longitudinal section of the extraction head of FIG. 1.
Figure 3:
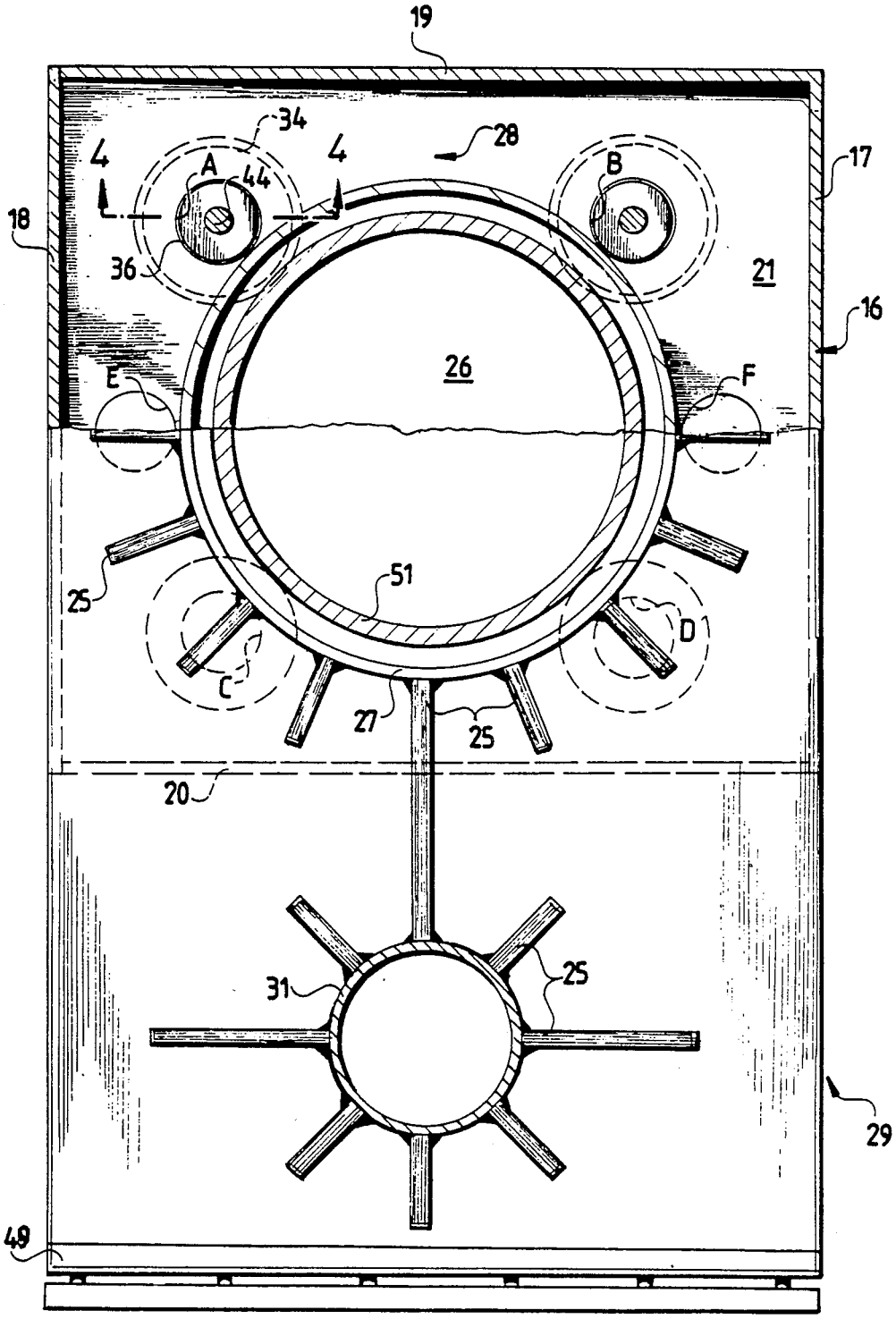
FIG 3 is a cross-sectional view along line 3—3 in FIG. 2.

FIGS. 2 and 3 show the construction of the extraction head 10 in detail. A parallel piped housing 16 comprising a rear wall 17, a front wall 18 and left and right side walls 19 and 20, respectively, has at the bottom a base plate 21 and at the top a flange plate 22 which consists for its part of two layers 23, 24 which are connected with one another by connection plates 25 and reinforced. The extraction pipe 11 and the compressed air duct 12 are flange connected in the conventional manner to the flange plate 22, namely to its upper layer 24.

The rectangular base plate 21 encloses a debris inlet opening 26. A cylindrical connecting pipe 27 enclosing the debris inlet opening extends between base plate 21 and flange plate 22 such that an annular compressed air space 28 is formed between the inner wall of the housing 16 and the outer wall of the connecting pipe 27, this compressed air space having on the outside a rectangular, e.g. quadratic, shape and on the inside a circular shape.

A right-angled box 29 is located laterally on the housing 16. Its interior space 30 is connected on the one hand with the compressed air duct 12 via a connecting pipe 31 and on the other hand with the annular compressed air space 28 via an opening 32. Several compressed air outlet openings A, B, C, D, E and F are arranged in the base plate 21 in the region of the compressed air space 28 (cf. FIG. 3), these openings being mutually spaced around the debris inlet opening 26 and opening downwardly into the open.

Figure 4:
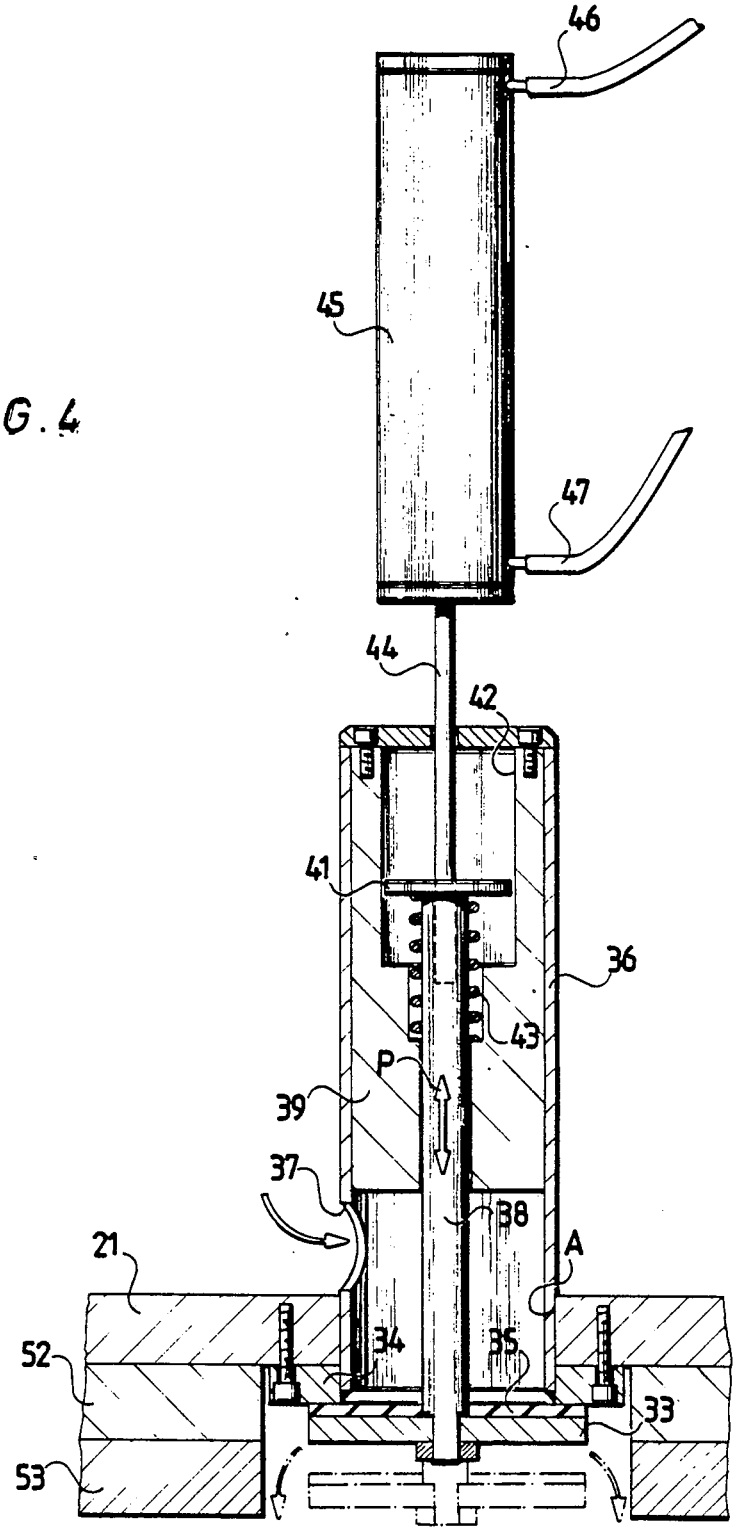
FIG. 4 shows a partial section along line 4—4 in FIG. 3.

As illustrated in FIG. 4 for the outlet opening A, each of these outlet openings is provided with a spring-loaded nonreturn valve 33 which can be joined from below to the outlet opening A in a sealing manner through the intermediary of a ring 34 screwed to the base plate 21 and a sealing layer 35 connected with the valve 33. As illustrated, a bushing 36 is rigidly welded into the outlet opening A and has a lateral compressed air inlet opening 37. The bushing 36 is located in the compressed air space 28 so that compressed air can enter through the opening 37. The nonreturn valve 33 is connected with the rod 38 extending coaxially through the bushing 36, this rod being reciprocating (arrow P) in a solid lining 39 which fills the bushing 36 at the top. A plate 41 is rigidly connected with the upper end of the rod 38 and displaceable in a recess 42 in the lining 39. A pressure spring 43 which is wrapped around the rod 38 extends between the plate 41 and the lining 39 and holds the nonreturn valve 33 in its closed state.

The piston rod 44 of a double acting pressure medium unit 45, preferably a hydraulic cylinder, is also connected with the upper end of the rod 38. Pressure medium which is selectively supplied via ducts 46, 47 causes displacement of the piston rod 44 downwardly or upwardly and, with it, the valve 33 so that the pressure medium outlet opening A can be arbitrarily opened or closed. The pressure medium supplied via the ducts 46, 47 to the unit 45, also located in the pressure medium space 28, originates from a pressure medium unit 48 which (without ducts) is schematically indicated in FIG. 2. As illustrated, the pressure medium unit 48 is located in the interior space 30 of the box 29. The pressure medium unit 48 comprises, in the conventional manner, a pressure medium supply and a pneumatic pump. Since the pressure medium unit 48 is thus located directly at the extraction head 10, pressure medium ducts up to the surface of the water are dispensed with. Only electrical control lines are required for actuating the pressure medium unit 48 and valves connected therewith accordingly so that the nonreturn valves 33, in particular at the compressed air outlet openings, are opened or closed. The box 29 is closed by a removable lid 49 so that the unit 48 is accessible.

As shown, in addition, in FIGS. 2 and 3, an expendable tube 51 extends within the connecting pipe 27 and is connected, on the one hand, rigidly with the upper layer 24 of the flange plate 22 and, on the other hand, with a ring 52. An expendable ring 53 is located below the ring 52. The rings 52, 53 are screwed to the base plate 51 from below such that the openings of the rings 52, 53 enclose the debris inlet opening 26. On its upper side the expendable tube 51 merges into the extraction pipe 11.

The tube 51 and the rings 52, 53 are interchangeable parts which can be exchanged when they become worn. In principle, the extraction head 10 does, however, also function without the expendable tube 51 and the rings 52, 53. In this case, the connecting pipe 27 has the debris flowing directly through it and is therefore subject to wear and tear. However, in view of the arrangement and design of the air outlet openings A–F, as described, the phenomena of wear are substantially less than in previous extraction heads.

The pneumatic extraction head as described operates in the following manner:

Once the extraction head 10 has been lowered onto the underwater debris with the aid of the hoists 6, 7, compressed air (or pressure water) is introduced into the compressed air space 28 via the compressed air duct 12, cf. the arrows in FIG. 2 which are directed substantially downwards. From there the compressed air flows into the bushings 36 arranged at the compressed air outlet openings A–F. Due to the pressure hereby exerted on the nonreturn valves 33, these open contrary to the action of the spring 43 (illustrated in FIG. 4 as a dash-dot line) so that the compressed air can exit downwards from the openings A–F and be deflected towards the debris 15. Following corresponding deflection, the compressed air escapes upwardly through the expendable tube 51 and the extraction pipe 11, water and debris being carried up to the surface of the water to the rebound tank 2. In this respect it is assumed that the pressure medium unit 45 is not in operation. Once the supply of compressed air is switched off, the nonreturn valves 33 close due to the action of the springs 43. It has been found that on account of the arrangement of the outlet openings A–F, a uniform, high extraction capacity is achieved, appearances of wear thereby occurring evenly, in particular on the ring 53 and the expendable tube 51, and certain areas of the extraction head are not subjected to excessive stress and strain by the extracted debris.

The extraction capacity may also be favourably influenced when the individual nonreturn valves 33 are controlled individually in a certain way with the aid of the pressure medium units 45 associated therewith. It is especially favorable for certain groups of nonreturn valves to be alternatingly opened and closed together. For example, the valves 33 at the openings A and B can be alternatingly opened or closed with the valves at the openings C to F. Accordingly, the valves 33 at the openings C, D or A, B, E, F can be alternatingly opened and closed. In addition, an alternating opening and closing of openings E, F relative to openings A to D is possible. Finally, the nonreturn valves 33 can be controlled such that all the openings A to F are alternatingly open or closed. The respective period of opening and closing can be, for example, several seconds. The mode of control is dependent each time on the extraction conditions, in particular the depth of the water, and the nature of the debris to be extracted, and may be easily tested and optimized at the site.

As illustrated, the back and front walls 17 and 18, respectively, of the extraction head housing 16 taper downwardly and end in points which penetrate somewhat into the debris to be extracted. Beneath the debris inlet opening 26, where the walls 17, 18 are not yet tapered, these walls are connected by several feed regulating strips 54 which are screwed onto the edges of the walls 17, 18 so as to be individually interchangeable. This enables the edge of the debris inlet opening 26 to be modified according to how many of such strips 54 are attached. It has been found that this also enables the extraction capacity to be altered in response to the type of debris (e.g., sand, gravel or the like).

An echo sounder 55, for measuring the distance between the sounder and the debris 15 to be extracted, is arranged on the underside of the box 29 enclosing the chamber 30. The extraction head 10 is lowered or raised each time in response to the measured distance such that it takes up the best possible extraction position. This steering of the extraction head 10 can be carried out fully automatically with the aid of the echo sounder 55. In this case, corresponding control signals are sent from the echo sounder 55 to the hoists 6, 7 arranged on the float 1, which trigger the relevant raising or lowering movements of the extraction head.

For the sake of clarity, the nonreturn valves 33 are shown in full in FIG. 3 only at the outlet openings A and B. In the preferred embodiment, nonreturn valves 33 of this type are provided at all the outlet openings A to F. It is also, however, possible to provide pressure medium units 45 for controlling these valves 33 only at some of the outlet openings A to F so that, when compressed air is supplied, the relevant nonreturn valves 33 are kept open by the prevailing pressure until the supply of compressed air is again switched off.

A total of six outlet openings A to F are provided at the extraction head 10 as described. The number of these openings can also be smaller, and openings E and F, in particular, can be omitted. It is essential that these openings are arranged as symmetrically and uniformly as possible at the debris inlet opening 26.

It has also been found that a type of vibratory effect can be conveyed to the extraction head by a corresponding timed control of the nonreturn valves 33, for example by common opening or closing of all the vavles in a predetermined rhythm. This means that the extraction head is better able to bury itself in the debris with the points provided,, at the bottom of its walls 17, 18. This vibratory or "jerk" effect can be utilized, in particular, for penetrating hard and tenacious geological layers which can sometimes cover gravel deposits or the like.

As shown in particular in FIGS. 2 and 4, the nonreturn valves 33 are arranged directly at the base plate 21 and, therefore, in the immediate vicinity of the debris inlet opening 26. It is therefore possible for a piece of debris, for example a pebble, to penetrate between the opened valve 33 and the base plate 21 and block the valve. To prevent this, the nonreturn valves 33 may be protected underneath, for example by gratings. It is better for the nonreturn valves 33 to be spatially separated from the debris inlet opening 26 and the compressed air outlet openings A to F, so that no debris can impede the operation of the nonreturn valves. An embodiment of this type is illustrated in FIG. 5.

Figure 5:
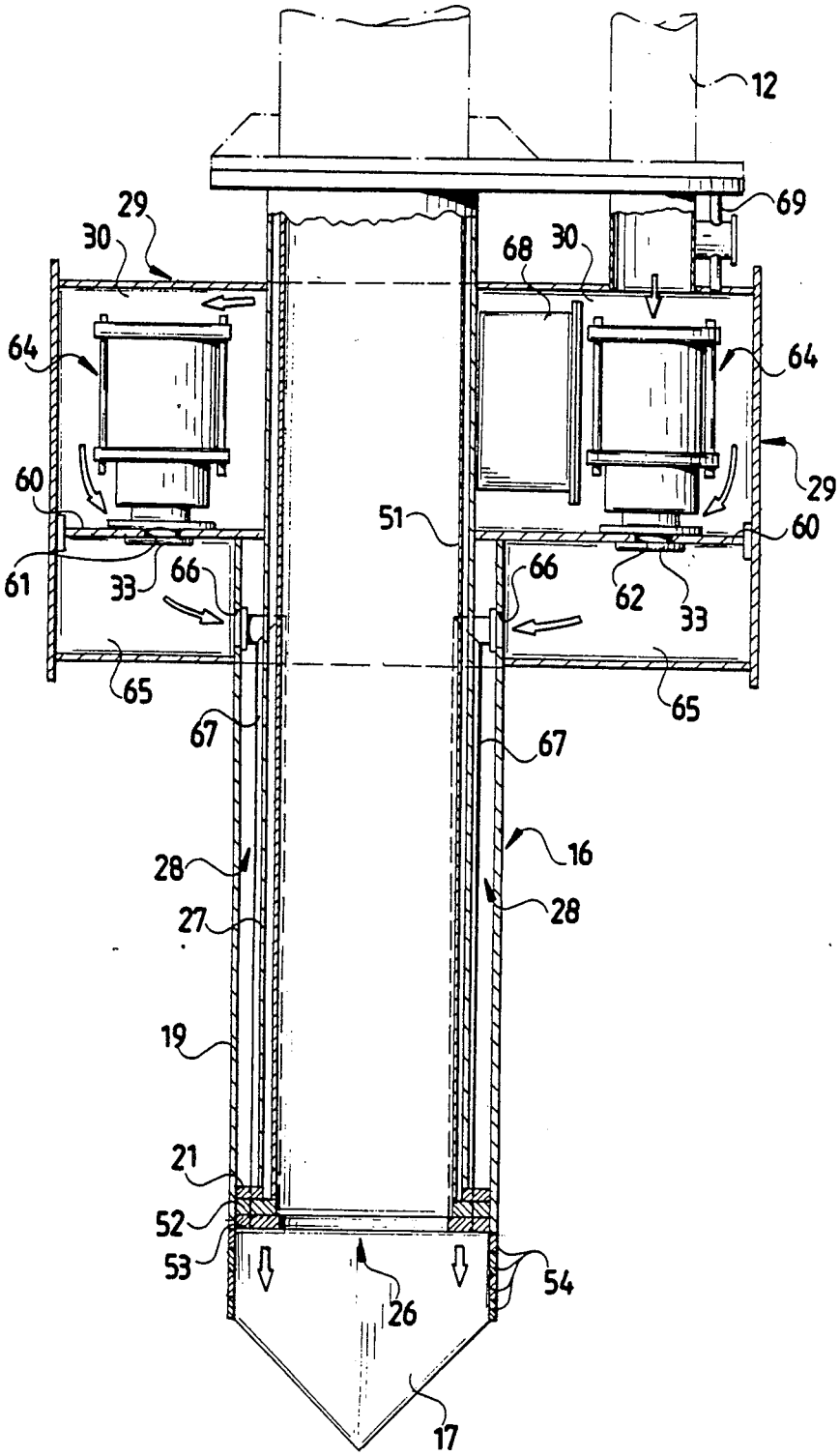
FIG. 5 shows a longitudinal section of a different embodiment.

The extraction head of FIG. 5 corresponds in the region of its inlet opening 26 exactly to the embodiment of FIGS. 2 and 3. In particular, its base plate 21 according to FIG. 3 has several, for example four, compressed air outlet openings A, B, C, D arranged symmetrically around the axis of the extraction head and in the compressed air space 28. The nonreturn plates required for controlling the exit of compressed air are, however, in contrast to FIG. 4, not arranged in the immediate vicinity of these compressed air outlet openings, as will be described later on.

The box 29, which is also provided on the extraction head according to FIG. 5, and the interior space 30 of which is again connected with the compressed air duct 12, extends, in contrast to FIGS. 2 and 3, around the entire outer housing 16, as shown in FIG. 5. A total of four openings are provided in a base plate 60 of the box 29, and of these openings, two are illustrated in FIG. 5, namely the openings 61 and 62. Each of these openings is arbitrarily closable by means of a nonreturn valve 33, each nonreturn valve 33 which is, again, preferably spring-loaded, being associated with an actuating or control device 64, for example a pneumatic or electromechanical control means.

Each of the openings which can be closed by a valve 33, for example, openings 61, 62, leads to chamber 65, which is sealed and separated from the interior space 30. Each chamber 65 has an opening 66 which is connected via a conduit 67 with one of the compressed air outlet openings A, B, C and D formed in the base plate 21. In this way, corresponding actuation of the nonreturn valves 33 will cause compressed air to exit at the desired compressed air outlet openings A to D. However, the valves 33 are spatially separated from the compressed air outlet openings A to D so that they cannot be blocked by debris. As also shown in FIG. 5, the conduits 67 conveying compressed air extend within the compressed air space 28 between the outer walls of the housing 16 and the connecting pipe 27.

The control means 64 in the chamber 30 are preferably designed as pneumatically operable means, similar to the arrangement of FIG. 4. The compressed air supplied via the compressed air duct 12 is utilized as compressed air in the chamber 30. A control box 68 provided in the chamber 30, and schematically indicated in FIG. 5, contains valves for actuating the individual control means 64. The control means 64 and the valves provided in the control box 68 can be vented, when required, via a vent line 69 provided at the box 29 and leading to the surface of the water.

I claim:

1. Pneumatic extraction head for underwater debris, for instance, sand and gravel, comprising a housing including a debris inlet opening in an open underside and a flange plate located at the top of the housing for connection with an extraction pipe and a compressed air duct, wherein a connecting pipe surrounding the debris inlet opening extends inside the housing between the debris inlet opening and the flange plate for forming a compressed air space between the inner wall of the housing and the outer wall of the connecting pipe and plural compressed air outlet openings are provided in the compressed air space, said extraction head further comprising, a base plate surrounding the debris inlet opening and arranged at the underside of the housing, said plural compressed air outlet openings being arranged at the base plate around the debris inlet opening in spaced relationship to one another; nonreturn valves for controlling the exit of compressed air and at said plural compressed air outlet openings; and control means arranged for controlling selectively at least one of the nonreturn valves to cause arbitrary opening and closing;

whereby air pressure exits from the compressed air outlet openings towards the debris, subsequent to which the air pressure, after being reversed, enters into the debris inlet opening together with the debris, and conveys the debris, together with the water, to the water surface.

2. Extraction head as defined in claim 1, wherein the nonreturn valves are arranged substantially directly at said plural compressed air outlet openings.

3. Extraction head as defined in claim 1, wherein the nonreturn valves are arranged so as to be spatially separated from at least one of said plural compressed air outlet openings, further comprising compressed air ducts connecting the nonreturn valves with said at least one of said plural compressed air outlet openings.

4. Extraction head as defined in claim 3, wherein the nonreturn valves are provided in a box located at a distance above the debris inlet opening.

5. Extraction head as defined in claim 3, wherein the compressed air ducts extend in the compressed air space.

6. Extraction head as defined in claim 1, further comprising an expendable tube replaceably arranged inside the connecting pipe between base plate and flange plate.

7. Extraction head as defined in claim 6, further comprising an expendable ring replaceably arranged at the debris inlet of the expendable tube.

8. Extraction head as defined in claim 1, wherein the housing is designed as a parallel-piped box comprising two walls protruding downwardly beyond the debris inlet opening, and said housing being connected below the debris inlet opening via replaceable feed regulating strips.

9. Extraction head as defined in claim 8, wherein the side walls taper below the feed regulating strips.

10. Extraction head as defined in claim 1, wherein the control means comprise pressure medium cylinders fed via a pressure medium unit, and wherein the pressure medium unit is located in a sealed chamber connected with the housing of the extraction head.

11. Extraction head as defined in claim 1, comprising a motor-driven lifting and lowering means, and an echo sounder attached to the extraction head for measuring the distance between the echo sounder and the debris to be extracted and for automatically actuating the lifting and lowering means to maintain a predetermined distance between the echo sounder and the debris to be extracted.

* * * * *